United States Patent [19]

Lauter et al.

[11] Patent Number: 5,056,719

[45] Date of Patent: Oct. 15, 1991

[54] APPARATUS FOR SIMULTANEOUSLY DISCHARGING A PLURALITY OF FLUIDS

[75] Inventors: Norbert Lauter, Verl; Wolfgang Kuhn, Schloss Holte-Stukenbrock, both of Fed. Rep. of Germany

[73] Assignee: Kopperschmidt-Mueller GmbH & Co. KG, Bielefeld, Fed. Rep. of Germany

[21] Appl. No.: 421,521

[22] Filed: Oct. 13, 1989

[30] Foreign Application Priority Data

Oct. 14, 1988 [DE] Fed. Rep. of Germany ..... 3834983

[51] Int. Cl.[5] ..... B05B 7/26

[52] U.S. Cl. ..... 239/526; 137/580; 239/587; 285/136

[58] Field of Search ..... 239/525, 526, 527, 528, 239/530, 587; 137/580, 315; 285/134, 136

[56] References Cited

U.S. PATENT DOCUMENTS

| | | | |
|---|---|---|---|
| 1,720,043 | 7/1929 | Harris | 239/530 |
| 2,188,069 | 1/1940 | Walsh | 285/136 |
| 2,204,756 | 6/1940 | Hasse et al. | 239/587 |
| 2,293,585 | 8/1942 | Bard | 285/136 |
| 2,417,491 | 3/1947 | Hill | 285/136 |
| 3,633,828 | 1/1972 | Larson | 239/526 |
| 3,990,731 | 11/1976 | Schnipke | 285/136 |
| 4,005,825 | 2/1977 | Schowiak | 239/526 |
| 4,103,938 | 8/1978 | Lasater et al. | 285/136 |
| 4,142,742 | 3/1979 | Cornett et al. | 285/136 |
| 4,713,257 | 12/1987 | Luttermöller | 427/27 |
| 4,752,034 | 6/1988 | Kuhn | 239/690 |
| 4,759,573 | 7/1988 | Delamare | 285/136 |
| 4,765,544 | 8/1988 | Kuhn | 239/698 |
| 4,842,203 | 6/1989 | Kuhn | 239/705 |
| 4,921,010 | 5/1990 | Spirer | 285/136 |
| 4,928,997 | 5/1990 | Reisener et al. | 285/136 |

FOREIGN PATENT DOCUMENTS

| | | | |
|---|---|---|---|
| 1059809 | 6/1959 | Fed. Rep. of Germany . | |
| 7633342 | 3/1981 | Fed. Rep. of Germany . | |
| 3236913 | 4/1984 | Fed. Rep. of Germany | 239/525 |
| 1857492 | 6/1962 | United Kingdom . | |

*Primary Examiner*—Andres Kashnikow
*Attorney, Agent, or Firm*—Peter K. Kontler

[57] ABSTRACT

A spray gun or fuel nozzle wherein the underside of the pistol grip handle is formed with a socket for a rotary insert which is connected to two or more supply conduits for flowable materials. The insert has passages which convey flowable materials from the respective conduits to discrete channels in or on the housing of the gun or nozzle. One of the passages can extend from the respective conduit to the inner end face of the insert to admit flowable material into a channel of the handle, and one or more passages can extend from the respective conduit or conduits to annular spaces which are provided in the peripheral surface of the insert and/or in the adjacent internal surface of the handle and each of which communicates with a discrete channel. At least one channel can be provided in a guard in front of the trigger which is actuatable by the hand holding the handle. The insert is rotatably installed directly in the handle or in a cupped receptacle which is non-rotatably but separably installed in the handle.

24 Claims, 2 Drawing Sheets

APPARATUS FOR SIMULTANEOUSLY DISCHARGING A PLURALITY OF FLUIDS

BACKGROUND OF THE INVENTION

The invention relates to improvements in apparatus for discharging flowable materials, and more particularly to improvements in apparatus which are designed to simultaneously discharge two or more fluids. Typical examples of such apparatus are so-called spray guns which can discharge mixtures of gaseous and liquid fluids, and so-called "nozzles" which can be used to admit fuel into the tanks of motor vehicles.

As used herein, the term "fluid" or "flowable material" is intended to denote a gaseous fluid, a liquid and/or a flowable solid material.

It is known to employ a gun of the type having a pistol grip handle and a barrel to admit fuel into the tank of a motor vehicle. It is also known to design a fuel-admitting gun or "nozzle" in such a way that it can simultaneously discharge a plurality of different fuels, e.g., a mixture of gasoline and oil of the type used in two stroke cycle engines. It is further known to employ an electrostatic or other spray gun to discharge a mixture of a gaseous fluid and a liquid or comminuted solid material. Similar apparatus are used for simultaneous discharge of different adhesive substances. Certain presently known guns are convertible so that they can discharge a single flowable medium or a mixture or discrete streams of different flowable media.

A presently known gun which is distributed by the assignee of the present application employs a housing having a barrel and a pistol grip handle. A first conduit is connected to the handle to supply a stream of air which is admitted into and is discharged from the barrel in response to opening of a valve which is controlled by a manually operable trigger. A second conduit serves to supply paint, wax, a flowable synthetic plastic material or another non-gaseous fluid to the front end of the barrel close to the locus where the two fluids are mixed prior to being discharged or where the two fluids are discharged without mixing. A drawback of such apparatus is that the weight of the second conduit and of the non-gaseous fluid therein affects the balance of the apparatus, i.e., the apparatus is top heavy or front heavy and is hard to manipulate when in actual use. In other words, the second conduit and its contents tend to pull the front end of the barrel in a downward direction so that the hand which holds the handle at the rear end of the barrel and controls the trigger must continuously resist the tendency of the barrel and of the second conduit to tilt the barrel in a direction to move the front end of the barrel to a level below the handle.

Another drawback of presently known spray guns and similar apparatus which are used to discharge a plurality of flowable materials is that the discrete conduits which supply different flowable materials tend to become entangled and resist changes in orientation of the barrel. Entanglement of the conduits can result in constriction of the path or paths for flowable material or materials in one or more conduits so that the ratio of fluid media which are discharged by such apparatus is changed to thereby affect the quality of the mixture issuing from the apparatus. The utilization of relatively stiff conduits which are less likely to be deformed contributes to the bulk and weight of conventional apparatus. Moreover, the manipulation of a relatively heavy and bulky apparatus is tiresome to the operator and can affect the quality of the work, e.g., when the apparatus is used to spray or otherwise apply a mixture, or several discrete streams or sprays, of flowable materials.

German Utility Model No. 1 857 492 to British Transport Commission discloses a lance-like cleaning implement which employs a substantially L-shaped housing for two conduits and a nozzle. One of the conduits admits compressed air and the other conduit admits pressurized water or another liquid. The liquid is atomized on admission into the nozzle so that the stream of air which issues from the nozzle contains a mist of finely atomized liquid. The implement of this Utility Model is intended for use as a means for cleaning buses or railroad cars and for analogous purposes.

German Auslegeschrift No. 1 059 809 of Redder discloses a spray gun wherein a first conduit admits compressed air into the lower end of the handle and two additional conduits serve to admit lacquer and a hardening agent into the front end of the barrel. The front end of the barrel has several orifices which discharge air and sprays of lacquer and hardening agent. The spray gun of Redder is top heavy and is difficult to manipulate, especially for relatively long periods of time.

German Utility Model No. 76 33 342.1 to Gerlieva Sprüh- und Antriebstechnik discloses a spray gun which is similar to that of Redder except that the front portion of the barrel supports a single liquid-admitting conduit. The liquid is drawn by one or more streams of compressed air which are admitted into the rear end of the barrel and flow toward and into the front end. This gun exhibits all drawbacks of the apparatus of Redder.

OBJECTS OF THE INVENTION

An object of the invention is to provide an apparatus which can discharge a plurality of flowable media, with or without mixing, and is constructed and assembled in such a way that the conduits or other means for supplying flowable media cannot adversely affect the balance of the apparatus and are less likely to become entangled than in heretofore known apparatus.

Another object of the invention is to provide an apparatus which is easier and simpler to manipulate than heretofore known apparatus.

A further object of the invention is to provide the apparatus with novel and improved means for receiving a plurality of flowable materials from the respective sources.

An additional object of the invention is to provide a novel and improved housing for use in the above outlined apparatus.

Still another object of the invention is to provide a portable apparatus which is constructed and assembled in such a way that the parts which is grasped by the hand or hands of an operator cannot become overheated even if the apparatus is used to discharge one or more heated flowable materials.

A further object of the invention is to provide an apparatus wherein the guard for the pistol grip handle can perform a plurality of useful functions.

An additional object of the invention is to provide a novel and improved method of preventing overheating of the handle in a spray gun or an analogous portable apparatus for simultaneous discharge of a plurality of different flowable materials.

Another object of the invention is to provide a novel and improved method of balancing the housing of a spray gun or an analogous apparatus.

A further object of the invention is to provide an apparatus which can be readily taken apart for convenient cleaning and can be reassembled with little loss in time.

Another object of the invention is to provide a novel and improved pistol grip handle for a spray gun or an analogous apparatus which can discharge one or more sprays or streams of identical or different flowable materials.

An additional object of the invention is to provide an apparatus which exhibits the above outlined features and advantages and can be utilized as a means for discharging a wide variety of materials including gaseous fluids, liquid fuels, lacquers, beverages, adhesives, waxes, paints and many others.

SUMMARY OF THE INVENTION

The invention is embodied in an apparatus (such as a spray gun, a fuel mixing "nozzle" or the like) for discharging a plurality of flowable materials. The improved apparatus comprises a preferably portable housing having a socket (e.g., in the form of a blind bore or hole) and a plurality of channels, one for each of the plurality of flowable materials and each communicating with the socket. The improved apparatus further comprises an insert (e.g., in the form of a cylindrical plug) which is turnably received in the socket and has a plurality of passages each of which communicates with a different channel in each angular position of the housing and insert relative to each other, and means (e.g., discrete conduits) for supplying a different flowable material to each passage of the insert. It is preferred to mount the insert in the socket in such a way that the housing and the insert are turnable relative to each other through at least 360 degrees.

The insert has a peripheral surface and the housing has an internal surface which surrounds the peripheral surface. At least one of these surfaces can be provided with at least one annular space (e.g., a groove bounded by a concave surface) which communicates with one of the passages and with one of the channels.

The insert has an end face and the discharge end of at least one of the passages can be provided in such end face. The housing has a bottom surface which is provided in the socket and is spaced apart from and confronts the end face of the insert. The intake end of at least one of the channels can be provided in the bottom surface. The bottom surface and the end face preferably define a chamber which is filled with fluid medium flowing from the discharge end of the at least one passage into the intake end of the at least one channel. The arrangement is preferably such that the discharge end of the at least one passage and/or the intake end of the at least one channel is at least substantially coaxial with the insert.

In accordance with one presently preferred embodiment of the invention, the housing includes a main portion and a receptacle (e.g., in the form of a cup) which is removably installed in the main portion and is provided with the socket for the insert. Such apparatus preferably further comprises means for non-rotatably holding the receptacle in the main portion of the housing. The receptacle has an internal surface which surrounds the peripheral surface of the insert, and at least one of these surfaces can be provided with at least one annular space (e.g., in the form of a circumferentially complete groove) which communicates with one of the passages and with one of the channels.

The insert can include an enlarged portion which is connected with the supplying means. Such enlarged portion is or can be outwardly adjacent the socket and serves to facilitate connection of the insert to the supplying means. It is presently preferred to design the housing in the form of a gun having a barrel and a pistol grip handle, and the socket is preferably provided in the underside of the handle.

The apparatus also comprises means for releasably holding the insert in the socket. Such holding means can comprise at least one pin or another male detent element which is provided in the housing and extends into the socket, and an annular peripheral groove or another suitable female detent element which is provided in the peripheral surface of the insert and receives a portion of the male detent element.

If the socket is provided in the aforementioned receptacle, the apparatus further comprises means for releasably retaining the insert in the receptacle. The means for releasably holding the insert in the receptacle can but need not be designed in the same way as the aforediscussed means for releasably holding the insert directly in the housing, i.e., in a housing which does not comprise a receptacle for the insert.

The housing can comprise a handle, particularly a pistol grip handle, which is provided with the aforementioned socket. Furthermore, the housing can comprise a guard in front of the handle, and at least one of the conduits can be provided in the guard. The housing further comprises a barrel which carries the handle at its rear end and comprises a fluid discharging front portion which is remote from the handle. A first end of the guard is preferably secured to the handle in the region of the underside of the handle (i.e., adjacent the socket), and a second end of the guard is preferably secured to the barrel in the region of the front portion of the barrel. If the housing includes a main portion (composed of the barrel and the handle) and a receptacle in the handle, the aforementioned socket is provided in the receptacle to receive the insert. The handle of such apparatus has a second socket which receives the receptacle. The arrangement is preferably such that a first portion of the receptacle is confined in the second socket and a second portion of the receptacle extends from the second socket and is secured to the first end of the guard.

The supplying means can include a conduit which admits a gaseous fluid into the aforementioned chamber between the bottom surface of the housing in the socket of the handle and the end face of the insert in the socket or between the bottom surface in the socket in the handle and the end face of the receptacle. A second chamber can be provided between a bottom end wall of the receptacle and the end face of the insert in the socket of the receptacle.

The discharge end of the passage which communicates with the aforementioned annular space in the peripheral surface of the insert and/or in the groove in the internal surface of the receptacle or handle is preferably disposed substantially diametrically opposite the intake end of the channel which communicates with such space when the insert assumes a predetermined neutral position with reference to the housing.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
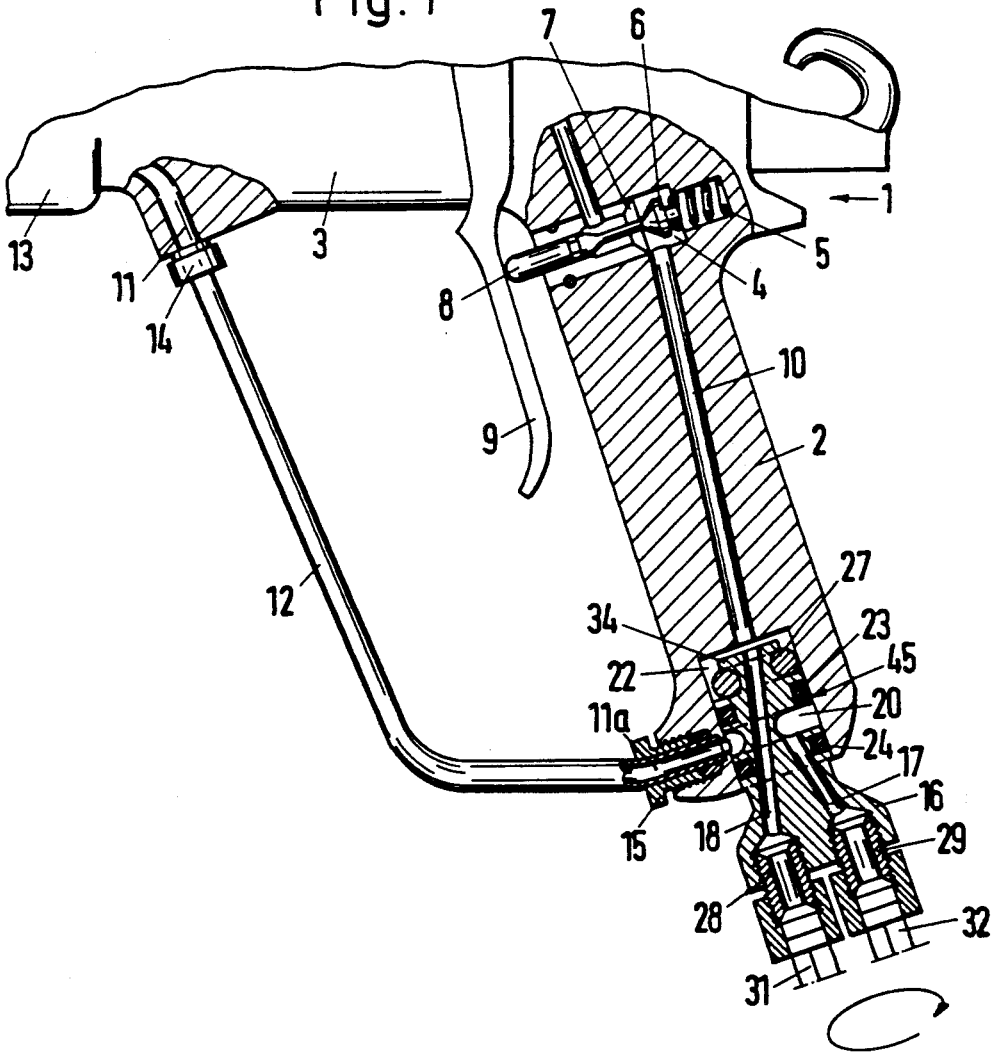
FIG. 1 is a fragmentary partly elevational and partly sectional view of an apparatus which constitutes or resembles a spray gun and embodies one form of the invention.

FIG. 1 shows a portion of an apparatus 1 which comprises a housing having a barrel 3 and a pistol grip handle 2 at the rear end of the barrel. The front end or front portion 13 of the barrel 3 contains or can contain a nozzle which discharges a mixture of two flowable media or two discrete flowable media, for example, a mixture of compressed air and paint, wax or the like. It is assumed that the apparatus 1 constitutes a spray gun wherein the front portion 13 of the barrel 3 contains a chamber for the mixing of a gaseous fluid (such as compressed air) with another flowable material, such as a pressurized liquid or a stream of comminuted solid material. However, it is equally possible to employ the improved apparatus 1 as a means for dispensing two discrete liquids or a mixture of two liquids, e.g., gasoline and oil for admission into the tank of a vehicle which is driven by a two stroke cycle engine. The manner in which two discrete flowable materials are, or a mixture of two flowable materials is, discharged from the front portion 13 of the barrel 3 is or can be the same as disclosed in commonly owned U.S. Pat. No. 4,713,257 to Luttermoöller, in commonly owned U.S. Pat. No. 4,752,034 to Kuhn et al., in commonly owned U.S. Pat. No. 4,765,544 to Kuhn et al. or in commonly owned U.S. Pat. No. 4,842,203 to Kuhn et al.

The handle 2 of the housing of the apparatus 1 of FIG. 1 is provided with a channel 10 and contains a valve 4 serving to regulate the flow of a first flowable material (particularly compressed air or another gaseous fluid) into the front portion 13 of the barrel 3. The intake end of the channel 10 is located in a bottom surface which is provided in a cylindrical socket 45 extending upwardly from the underside of the handle 2. The valve 4 comprises a reciprocable valving element 6 which is biased toward engagement with a seat 7 by a valve spring 5 and has an extension or plunger 8 which can be depressed by a trigger 9. The latter is pivotably mounted in or on the barrier 3 and can be grasped by one finger of the hand which holds the handle 2. Other types of valves can be used with similar or equal advantage.

A second channel 11 is provided in part in the barrel 3, in part in the handle 2 and in part in an arcuate hollow guard 12 which is located in front of and is spaced apart from the trigger 7. The upper end of the hollow guard 12 is separably secured to the barrel 3 by a first externally threaded connector 14. The means for separably securing the lower end of the guard 12 to the lower end of the handle 2 comprises a second externally threaded connector 15.

In accordance with a feature of the invention, the socket 45 in the lower portion of the handle 2 serves to receive an insert 16 in the form of a substantially cylindrical plug which is rotatable with reference to the handle 2 (and/or vice versa) through an angle of at least 360 degrees. The means for releasably holding the insert 16 in the socket 45 comprises cooperating male and female detent elements. The male detent element comprises one or more pins 27 which are removably installed in the handle 2 and have portions extending into the socket 45. The female detent element comprises an annular groove beneath a ring-shaped collar or rim 34 at the upper end of the insert 16 in the socket 45. Portions of the pins 27 extend into the groove beneath the collar 34 to permit rotation of the insert 16 relative to the handle 2 (and/or vice versa) but to prevent uncontrolled extraction of the insert from the socket 45. The pins 27 can be provided with externally threaded portions which are received in tapped bores of the handle 2. It is clear that a single pin 27 suffices to rotatably hold the insert 16 in the socket 45 and that such pin or pins can be replaced with one or more screws each having a shank with the tip of the shank extending radially of the insert into the groove beneath the collar 34.

The insert 16 is provided with two passages 17 and 18. The intake end of the passage 17 (e.g., in the from of a straight bore or hole) communicates with the interior of a first externally threaded nipple 29, and the intake end of the passage 18 communicates with the interior of a second externally threaded nipple 28. The nipples 28, 29 are threaded into tapped bores of the insert 16, namely of an enlarged lower portion of the insert which is located outside of the socket 45, i.e., which is adjacent the underside of the handle 2. These nipples can be said to form part of a means for supplying two different flowable materials to the channels 10 and 11 of the apparatus 1. The supplying means further comprises a first conduit 32 having an internally threaded head which is separably connected with the exposed portion of the nipple 29, and a second conduit 31 having an internally threaded head mating with the exposed portion of the nipple 28. Each of the two conduits 31, 32 can include or constitute a flexible hose.

The discharge end of the passage 17 communicates with an annular space 20 which is a groove machined into or otherwise formed in the cylindrical peripheral surface of the insert 16. This annular space 20 is in permanent communication with the intake end 11*a* of the channel 11 so that, when the conduit 32 is free to receive a liquid or a flowable comminuted solid material, such material is free to flow through the nipple 29, passage 20 and channel 11 into the front portion 13 of the barrel 3.

The discharge end of the passage 18 is located in the upper end face of the insert 16. Such end face is spaced apart from the aforementioned bottom surface of the handle 2 in the socket 45, i.e., from the intake end of the channel 10. The arrangement is preferably such that the discharge end of the passage 18 and/or the intake end of the channel 10 is at least substantially coaxial with the cylindrical portion of the insert 16, i.e., the axis about which the insert can turn relative to the handle 2 coincides with or is at least close to the axis of the intake end of the channel 10 and/or the axis of the discharge end of the passage 18. The bottom surface of the handle 2 in the socket 45 is spaced apart from the end face of the insert 16 to define with the latter a relatively small chamber 22 for equalization of pressure in the body of flowable material which flows from the conduit 31, through the nipple 28 and channel 18, into the chamber 22 and thence into the channel 10 of the handle 2 and barrel 3. As explained above, this flowable material is or can be a gaseous fluid and its flow is regulated by the valve 4 which can seal the respective portion of the channel 10 or permits gaseous fluid to flow at a controlled and variable rate from the chamber 22 into the front portion 13 of the barrel 3.

Figure 2:
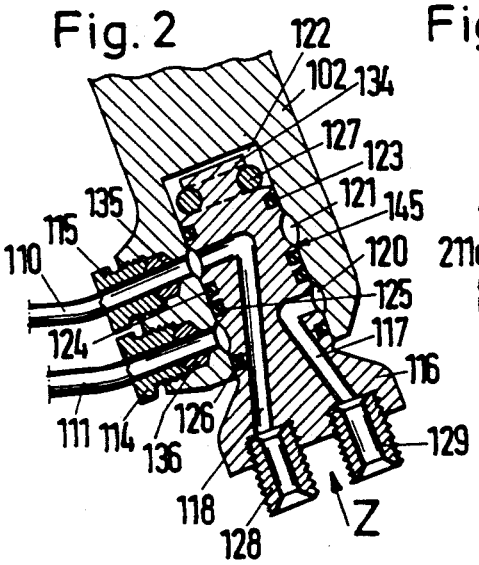
FIG. 2 is a fragmentary sectional view of a second apparatus.
Figure 4:
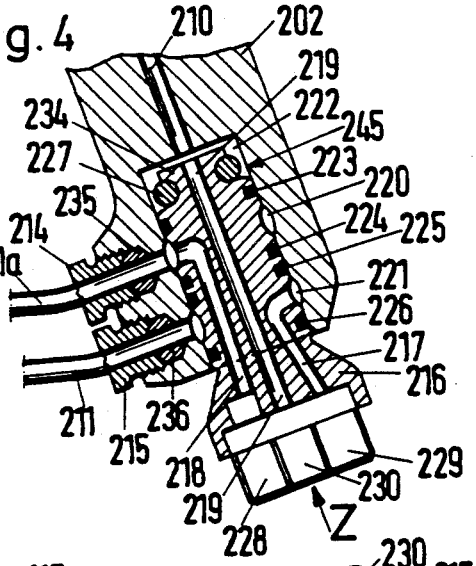
FIG. 4 is a fragmentary sectional view of a third apparatus.
Figure 7:
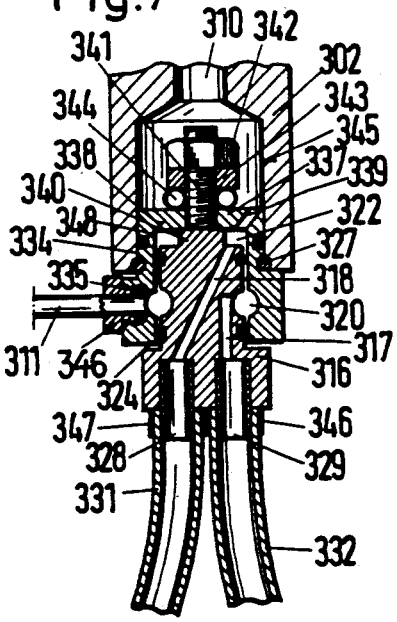
FIG. 7 is an enlarged fragmentary sectional view of the fourth apparatus.

The annular space 20 can be formed in the cylindrical internal surface of the handle 2 which surrounds the peripheral surface of the insert 16. Still further, it is possible to design the apparatus in such a way that a first portion of the annular space 20 is provided in the peripheral surface of the insert 16 and a second portion of this annular space is provided in the internal surface surrounding the peripheral surface of the insert. This is shown in FIGS. 2, 4 and 7.

The insert 16 tends to assume a neutral angular position which is shown in FIG. 1 and in which the discharge end of the passage 17 is located substantially diametrically opposite the intake end 11*a* of the channel 11. This ensures that the stream of flowable material issuing from the passage 17 is divided into two equal or similar streams which flow in the annular space 20 toward and into the intake end 11*a* of the channel 11. However, the flowable material which is delivered by the passage 17 can enter the space 20, and hence the intake end of the channel 11, in each and every angular position of the handle 2 and insert 16 relative to each other. The same applies for the flow of air or another gas from the passage 18 into the chamber 22 and thence into the channel 10. The supply of gaseous fluid in the chamber 22 serves as a buffer or cushion and ensures that the resistance to the flow of fluid into the channel 10 is not pronounced or excessive even if the discharge end of the passage 18 is not accurately aligned (coaxial) with the intake end of the channel 10.

An advantage of the enlarged lower portion of the insert 16 is that it provides more room for installation of the nipples 28, 29 and for connection of such nipples to the heads of the respective conduits 31, 32.

At least one first annular sealing element 23 (e.g., an O-ring) is recessed into the peripheral surface of the insert 16 to seal the annular space 20 from the chamber 22. At least one annular second sealing element 24 (e.g., an O-ring) is recessed into the peripheral surface of the insert 16 to seal the annular space 20 from the atmosphere.

The conduit 32 can be connected with a source of flowable solid material or with a source of liquid, e.g., with a source of liquid or liquefied wax, paint or lacquer. Compressed gaseous fluid which is supplied by the conduit 31 and enters the front portion 13 of the barrel 3 via channel 10 can be used as a means for atomizing the liquid which is supplied by the channel 11.

The liquid which is flows through the channel 11 can be admitted at an elevated temperature. This does not cause any inconvenience or discomfort to the person holding the handle 2 because the channel 11 bypasses at least the major portion of the handle by flowing from the annular space 20 of the insert 16 and thence by way of connector 15, guard 12 and connector 14 directly or practically directly into the front portion 13 of the barrel 3.

The insert 16 can be readily withdrawn from the socket 45 upon partial or complete extraction of the pins 27. Separation of the insert 16 from the handle 2 facilitates cleaning of the socket 45, annular space 20 and channel 17, especially upon detachment of the heads of conduits 31, 32 from the respective nipples 28, 29. Reinsertion of the insert 16 into the socket 45 is an equally simple and short-lasting procedure, i.e., all that is necessary is to force the sealing elements 23, 24 into the socket 45 and to thereupon reintroduce the pins 27 into the annular groove adjacent the collar 34.

The improved apparatus 1 can be readily cleaned even if the insert 16 remains attached to the handle 2. All that is necessary is to detach the head of the conduit 32 form the nipple 29 and to attach this nipple to a source of pressurized cleaning or rinsing fluid. Such fluid flows through the channel 11 and is discharged from the front portion 13 of the barrel 3. The just discussed cleaning or rinsing operation preferably takes place when the insert 16 is maintained in the illustrated neutral angular position; this ensures uniform cleaning of both halves of the annular space 20 between the discharge end of the passage 17 and the intake end 11*a* of the channel 11.

As a rule, the channel 10 need not be cleaned if this channel serves to convey a stream of gaseous fluid, such as compressed air. However, if a cleaning of the channel 10 is necessary or desirable, the operator simply detaches the head of the conduit 31 from the nipple 28 and uses this nipple for admission of a cleaning or rinsing fluid which flows through the passage 18, chamber 22 and channel 10 to be discharged from the front portion 13 of the barrel 3.

Figure 3:
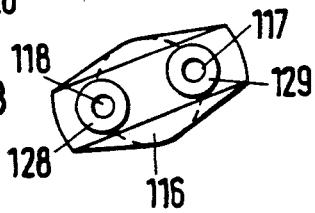
FIG. 3 is an end elevational view of the insert in the second apparatus, substantially as seen in the direction of arrow Z in FIG. 2.

FIGS. 2 and 3 show a portion of a modified apparatus. All such parts of this apparatus which are identical with or clearly analogous to the apparatus 1 of FIG. 1 are denoted by similar reference characters plus 100. The insert 116 is not provided with a passage which extends all the way to its end face in the socket 145 of the handle 102. Instead, the peripheral surface of this insert is provided with two annular grooves each of which communicates with the discharge end of a discrete passage 117, 118. The grooves in the peripheral surface of the insert 116 form part of two composite annular spaces 120, 121 each of which further includes an annular portion or groove which is machined into or is otherwise formed in the internal surface of the handle 102, namely in that surface which surrounds the peripheral surface of the insert 116 in the socket 145.

The annular spaces 120, 121 communicate with two discrete channels 110, 111 which preferably extend through the guard (not shown) in front of the handle 102 or are simply exposed in the regions between the respective threaded connectors 115, 114 and the front portion of the barrel (not shown). The connectors 114, 115 further serve to stress discrete annular sealing elements 136, 135 which prevent communication between the intake ends of the channels 111, 110 and the atmosphere. A sealing element 123 is recessed into the peripheral surface of the insert 116 to seal the chamber 122 from the annular space 121; two additional sealing elements 124, 125 are provided to seal the annular spaces 120, 121 from each other; and a further sealing element 126 is employed to seal the annular space 120 from the atmosphere. Each of these sealing elements can constitute an O-ring. The chamber 122 is not needed in the apparatus of FIG. 2, i.e., the upper end face of the insert 116 can actually abut or can be very close to the bottom surface of the handle 102 in the socket 145.

The discharge end of the passage 117 is located substantially diametrically opposite the discharge end of the passage 118 (with reference to the axis of the insert 116). However, it is equally within the purview of the invention to place the discharge ends of the passages 117, 118 next to each other so that they are spaced apart from one another only in the axial direction of the insert 116.

An apparatus of the type shown in FIG. 2 can be used with advantage if each of the channels 110, 111 serves to convey a hot flowable material. Thus, the handle 102 need not be provided with one or more channels but is merely formed with the socket 145 and with short tapped bores for the threaded connectors 114, 115. These tapped bores are preferably adjacent the underside of the handle 102, i.e., they are or they can be remote from that part of the handle which is grasped by hand when the apparatus of FIG. 2 is in use.

By way of example, the channels 110 and 111 can be used to convey two heated components of an adhesive substance which must be mixed and/or applied at an elevated temperature.

FIG. 3 shows that the exposed lower portion of the insert 116 is elongated to provide ample room for tapped bores which receive portions of the nipples 128 and 129. Moreover, such design of the exposed portion of the insert 116 contributes to convenience of attachment of conduits (such as 31, 32) to or detachment of conduits from the nipples 128, 129. It is not necessary to provide the conduits with internally threaded heads for attachment to the nipples 128, 129. For example, conduits in the form of hoses can be simply slipped onto the nipples 128, 129 and held there on by suitable hose clamps or the like (note the clamps 346, 347 in FIG. 7).

If the operator wishes to extract the insert 116 from the socket 145, the pins 127 are retracted so that they are withdrawn from the groove adjacent the collar or rim 134. This facilitates inspection and/or cleaning of the insert 116 and/or of the channels 110, 111.

Figure 5:
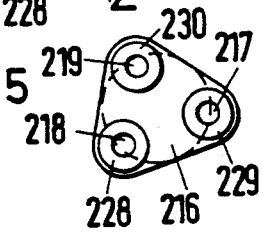
FIG. 5 is an end elevational view of the insert in the third apparatus, substantially as seen in the direction of arrow Z' in FIG. 4.

FIGS. 4 and 5 show a portion of a third apparatus. All such parts of this apparatus which are identical with or clearly analogous to the corresponding parts of the apparatus 1 of FIG. 1 are denoted by similar reference characters plus 200. The apparatus of FIGS. 4 and 5 is designed to spray or to otherwise discharge a mixture or discrete streams of three flowable media. To this end, the insert 216 is provided with passages 217, 218 (corresponding to the passages 117, 118 in the insert 116 of FIG. 2) and a third passage 219 which corresponds to the passage 18 in the insert 16 of FIG. 1. For the sake of convenience and simplicity of illustration, the passages 117 to 119 are shown as being located in a common plane; however, it will be understood that portions of or the entire passages can be located in two or more different planes.

The passage 219 can be used to deliver compressed air or another compressed gaseous fluid into a relatively small chamber 222 between the upper end face of the insert 216 and the bottom surface of the handle 202 in the socket 245. The annular spaces 220 and 221 are formed in the same way as described with reference to FIG. 2, i.e., partly in the peripheral surface of the insert 216 and partly in the adjacent internal surface of the handle 202. The intake end of the channel 210 in the handle 202 is at least substantially coaxial with the discharge end of the passage 219 and is in permanent communication with the chamber 222. An advantage of the illustrated positioning of the intake end of the channel 110 and of the discharge end of the passage 219 relative to each other is that the flow of compressed gaseous fluid from the passage 219 into the channel 210 is practically unobstructed, i.e., the flow of such fluid is not throttled or otherwise restricted. This renders it possible to admit compressed gaseous fluid into the front portion of the barrel (not shown) at an elevated pressure or to reduce the pressure of compressed gaseous fluid in the source which is connected to the nipple 230, i.e., to the means for supplying gaseous fluid to the passage 219.

The discharge ends of the passages 217, 218 are in permanent communication with the respective annular spaces 221, 220, and these annular spaces are in permanent communication with the intake ends of the channels 211*a*, 211, respectively. The channels are separably secured to the lower portion of the handle 202 by threaded connectors 214, 215 which further serve to stress the respective sealing elements 235, 236. The exposed lower portion of the insert 216 carries three nipples 228, 229, 230, one for each of the three passages 218, 217, 219. The sealing elements 223, 224, 225 and 226 (e.g., in the form of O-rings) serve to seal the chamber 222 from the annular space 220, to seal the annular spaces 220, 221 from each other, and to seal the annular space 221 from the atmosphere. Thus, flowable material which is admitted via nipple 228 cannot mix with the material which is admitted via nipple 229 and/or 230 except (if necessary) in or in front of the front portion of the barrel (not shown). The channels 211, 211*a* can be self-supporting between the connectors 215, 214 and the front portion of the barrel, or they may be confined in or they can form part of a guard corresponding to the guard 12 of the apparatus 1 which is shown in FIG. 1.

FIG. 5 shows that the exposed lower portion of the insert 216 has a substantially triangular shape with each of the nipples 228, 229 and 230 received in a different corner of the lower portion. This provides ample room for the nipples and facilitates attachment of the nipples to, or their detachment from, the respective conduits, not shown. The surfaces bounding the corners of the enlarged lower portion of the insert 216 are preferably rounded.

Each of the nipples 228, 229 can receive a stream of liquid or a stream of a flowable solid material. Of course, it is equally possible to use two or all three nipples for admission of a gaseous fluid, for admission of a liquid or for admission of a flowable solid material. Furthermore, one of the nipples 228–230 can be sealed if the apparatus of FIGS. 4 and 5 is to discharge only two flowable materials. Two of the three nipples will be sealed if the apparatus is used to discharge a single flowable material.

Figure 6:
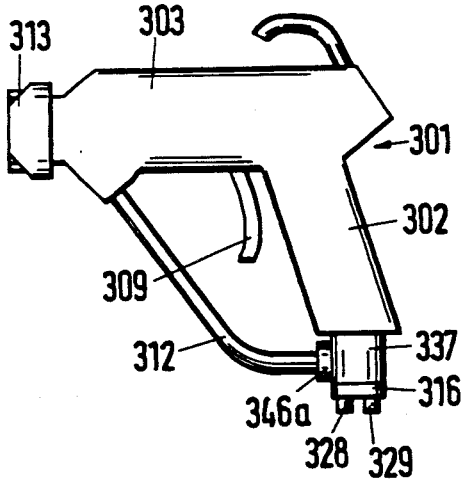
FIG. 6 is a schematic elevational view of a fourth apparatus.

FIGS. 6 and 7 show a fourth apparatus 301. All such parts of this apparatus which are identical with or clearly analogous to corresponding parts of the apparatus of FIG. 1 are denoted by similar reference characters plus 300. The housing of the apparatus 301 comprises a main portion composed of the handle 302 and barrel 303, and a cupped receptacle 337 for the insert 316. The underside of the handle 302 is provided with a socket 345 for the receptacle 337, and the latter has a socket 348 for the insert 316. The means for releasably holding the receptacle 337 in the socket 345 comprises two male detent elements in the form of pins 327 which are movably installed in the handle 302 and extend into recesses in the peripheral surface of the handle 302 close to the open lower end of the socket 345. These recesses are located below a circumferentially complete annular portion 334 of the receptacle 337. The means for removably retaining the insert 316 in the socket 348 of the receptacle 337 comprises an externally threaded extension or shank 341 forming part of the insert and extending through an axial hole in the upper end wall 338 of the receptacle. The retaining means further comprises a nut 342 which is located in the socket 345 and meshes with the shank 341, and a thrust bearing 344 between the end wall 338 and a washer 343 beneath the nut 342. The thrust bearing 344 ensures that the insert 316 can be turned in the socket 348 in response to the exertion of a relatively small effort.

The apparatus 301 further comprises means (such as the aforementioned pins 327 for non-rotatably holding the receptacle 337 in the socket 345 of the handle 302. On the other hand, the receptacle 337 and the insert 316 are rotatable relative to each other through an angle of at least 360 degrees.

The channel 311 which extends through the guard 312 need not extend through the main portion 302+303 of the housing of the apparatus 301; instead, the lower end portion of this guard is separably secured to the exposed lower portion of the receptacle 337 by an externally threaded connector 346*a* which further serves as a means for deforming a sealing element 335 serving to prevent leakage of flowable material from the intake end of the channel 311 into the surrounding atmosphere. The manner in which the upper or front portion of the guard 312 is separably secured to the barrel 303 adjacent the front portion 313 of the barrel is or can be the same as described with reference to FIG. 1.

The enlarged lower portion of the insert 316 extends from the receptacle 337 and carries two nipples 328, 329 which are connected to the adjacent ends of conduits 331, 332 serving as a means for supplying flowable materials into the corresponding passages 318, 317 of the insert. The nipple 328 admits flowable material (e.g., compressed air or another gas) into the passage 318 whence the material flows into the chamber 322 adjacent the end wall 338 of the receptacle 337. The end wall 338 has one or more ports 339 which admit flowable material into the unoccupied portion of the socket 345 for entry into the intake end of the channel 310 in the handle 302.

The peripheral surface of the insert 316 and the adjacent internal surface of the receptacle 337 define a composite annular space 320 which is in permanent communication with the discharge end of the passage 317 and also with the intake end of the channel 311. Sealing elements (including that denoted by the reference character 324) are employed to seal the annular space 320 from the atmosphere, to seal the annular space 320 from the chamber 322 and to seal the upper portion of the socket 345 (and hence the port or ports 339 and the intake end of the channel 310) from the atmosphere.

The nipples 328, 329 have externally threaded portions which mate with the lower portion of the insert 316, and lower portions which are surrounded by the respective conduits 331, 332. These conduits are releasably coupled to the nipples 328, 329 by suitable hose clamps 347, 346 which are shown schematically in the lower portion of FIG. 7.

The guard 312 can be omitted, or this guard can serve the sole purpose of preventing accidental pivoting of the trigger 309, if the channel 311 is designed as a flexible hole or as a rigid pipe which extends between the connector 346*a* and the front portion 313 of the barrel 303, i.e., if the channel 311 need not be confined in the guard.

The upper portion of the insert 316 is provided with a boss 340 having a diameter which is larger than that of the shank 341 and of the centrally located hole in the end wall 338 of the receptacle 337. This ensures that the insert 316 and the receptacle 337 define the aforementioned chamber 322 between the discharge end of the passage 318 and the port or ports 339.

If it is desired or necessary to inspect or clean the receptacle 337 and the insert 316, the pins 327 are extracted from the recesses beneath the collar 334 of the receptacle so that the latter can be withdrawn from the socket 345. This affords access to the nut 342 which is detached from the shank 341 so that the insert 316 can be extracted from the receptacle 337. It is preferred to slip the conduits 331, 332 onto the respective nipples 328, 329 prior to introduction of the insert 316 into the receptacle 337 because this simplifies the application of clamps 347 and 346.

The insert 316 is reintroduced into the socket 348 of the receptacle 337 before the latter is reinserted into the socket 345 of the handle 302.

The pins 327 cooperate with the surfaces bounding the respective recesses beneath the collar 334 to hold the receptacle 337 against rotation in the handle 302 and to maintain the receptacle in a predetermined angular position. If the pins 317 extend into a circumferentially complete groove in the peripheral surface of the receptacle 337, the latter can be provided with a protuberance (not specifically shown) which is receivable in a complementary axially parallel groove of the handle 302 to ensure that the receptacle can enter the socket 345 only while it assumes a predetermined angular position. The positions of the just mentioned protuberance and groove can be reversed without departing from the spirit of the invention.

The apparatus 301 of FIGS. 6 and 7 exhibits the advantage that the assembly of the conduits 331, 332 with the insert 316 is simple and convenient, and this apparatus renders it possible to avoid the establishment of direct contact between at least one (311) of the channels and the handle 302 of the housing. The insert 316 and the receptacle 337 can be assembled into a unit which is ready to be installed in the socket 345 of the handle 302. Moreover, the thrust bearing 344 reduces the effort which is required to turn the insert 316 with reference to the handle 302. The receptacle 337 can be reliably held in the socket 345 because it need not turn with reference to the handle 302.

An important advantage of each illustrated embodiment of the improved apparatus is that it is not necessary to attach one or more conduits directly to the barrel of the housing in front of the handle. This reduces or eliminates the tendency of the housing to move the front portion of the barrel downwardly, i.e., the hand holding the handle must exert a lesser effort in order to properly aim the front portion of the barrel upon an object to be coated or into the opening leading to the fuel tank of a motorcycle or another motor vehicle.

Another important advantage of the improved apparatus is that the housing can be readily swung to the right or to the left without risking entanglement of the fluid-supplying conduits. Therefore, the conduits are less likely to unduly restrict or throttle the flow of fluids therein even if they constitute highly flexible hoses. Furthermore, the conduits offer less resistance to swinging of the housing to the left, to the right, upwardly or downwardly because their discharge ends are connected to the insert, i.e., to a part at the lower end of the handle.

If the front portion of the barrel constitutes or includes a device for mixing two or more fluids, e.g., for mixing two or more fuels (such as gasoline and oil), the improved apparatus can be used as a means for admitting such mixture into the tank of a vehicle or another machine which operates with a two stroke cycle engine. Moreover, the improved apparatus can be used to mix two or more beverages, e.g., wine and water to produce spritzers. Still further, the front portion of the barrel can be designed to discharge several discrete streams, sprays or other flows of two or more different flowable materials, e.g., two discrete components of a composite adhesive which are to be applied to an object in the form of elongated strips or the like.

A further important advantage of the improved apparatus is that the housing and the insert are turnable relative to each other, preferably through angles of at least 360 degrees. This greatly reduces the effort which is required to manipulate the apparatus and to properly aim the front end of the barrel in the desired direction. The conduits which are connected to the exposed portion of the insert do not tend to change the angular position of the housing because the insert and the handle are free to turn relative to each other. Changes in angular position of the handle relative to the insert and/or vice versa do not affect the flow of flowable materials from the conduits into the respective channels because the discharge ends of the passages in the insert are free to communicate with the intake ends of the respective channels in each and every angular position of the insert relative to the housing and/or vice versa. The housing is better balanced than the housing of a conventional apparatus because both or all supply conduits are connected to one and the same (relatively small) part of the apparatus, namely to the insert which is free to turn relative to the handle. Therefore, the operator of the improved apparatus can concentrate practically exclusively upon the task of properly directing one or more sprays or streams of flowable material or materials upon the target, be it the opening leading to a fuel tank, a glass or another vessel for a beverage or an object which is to be coated with paint, lacquer, wax, adhesive or another substance.

The conduits can be connected to each other without interfering with the manipulation of the improved apparatus. If the nipples of the insert are spaced apart from each other (e.g., in a manner as shown in FIG. 3 or in FIG. 5), it might be necessary to separate the heads of the conduits in order to permit attachment of each head to the respective nipple. However, the major portions of two or more conduits can remain attached to each other or they can be confined in a common sheath without interfering with the manipulation of the improved apparatus. The possibility that two or more interconnected conduits might offer a greater resistance to flexing than two or more discrete conduits which are freely movable relative to each other is of no consequence because the insert is free to turn relative to the handle. Moreover, and if the major portions of two or more conduits are connected to each other, such conduits are much less likely to be misplaced, misaligned or intertwined while they are detached from the housing, either with or without the respective insert. In other words, the conduits can form a bundle irrespective of whether or not they are attached to the insert and irrespective of whether or not the insert is attached to the housing.

Certain presently preferred combinations of flowable materials which can be dispensed with the improved apparatus include air or another gaseous fluid and a lacquer, air or another gaseous fluid and a synthetic resin, two or more components of an adhesive substance, two or more fuels having different octane numbers, gasoline and oil, wine and soda water, tonic or water or soda and other types of alcoholic beverages.

An advantage of the annular space or spaces which surrounds or surround the insert is that changes in angular position of the insert and handle relative to each other do not appreciably affect the flow of fluid medium from the respective passage of the insert into the corresponding channel. Thus, and unless the discharge end of the passage is moved directly in front of the intake end of the associated channel, the medium is free to flow in the respective annular space in clockwise and counterclockwise directions to advance from the discharge end of the passage toward and into the intake end of the channel.

It is possible to employ a substantially conical or frustoconical insert. However, plug-shaped inserts wherein the portions which extend into the respective sockets have a cylindrical shape are preferred at this time because such cylindrical parts can be mass-produced and finished at a reasonable cost. The same holds true for the making of sockets which are bounded by cylindrical internal surfaces of the respective handles. Still further, the annular spaces in the peripheral surfaces of cylindrical inserts can be readily sealed from each other, from the respective chambers and from the atmosphere. Moreover, a cylindrical insert can be readily introduced into and withdrawn from a complementary socket. Sealing is simple and can be carried out with available O-rings or analogous sealing elements. The sealing action is highly satisfactory because the neighboring chambers, spaces, grooves and/or other cavities are equidistant from each other in the axial direction of a cylindrical insert.

An advantage of passages which extend all the way between the two end faces of an insert is that they can be formed at a reasonable cost. For example, and referring again to FIG. 4, the passage 219 can constitute a straight axial bore or hole of the insert 216. The making of the passage 18 or 320 is equally simple even though these passages are not coaxial with the respective inserts. The advantages of placing the discharge end of a passage which terminates in the inner end face of an insert directly opposite the intake end of a channel in the housing of the improved apparatus were pointed out hereinbefore. Thus, the flow of a medium which leaves the discharge end of such a passage (note, for example, the passage 219 in FIG. 4) to enter the intake end of the corresponding channel (210) is not obstructed (particularly throttled) by sharp edges or the like, i.e., the medium encounters a minimum of resistance to flow into the respective channel so that it can be admitted at a lesser pressure.

While it is equally within the purview of the invention to install the insert at a location other than in the underside of the handle, the illustrated location is preferred at this time because the conduits and their contents are least likely to adversely influence the balance of the housing when the apparatus is in actual use. Furthermore, the conduits which extend from the lowermost part of the handle are least likely to adversely affect the convenience of manipulation of the apparatus. It can be said that the conduits constitute downward extensions of the handle. The just outlined advantages can be achieved irrespective of whether or not the conduits form a bundle of coherent conduits. The combined weight of the conduits is least likely to influence the manipulation of the apparatus and is least likely to necessitate frequent interruptions of operation of the apparatus if the conduits are affixed to an insert which is installed in the lowermost portion of the handle.

The aforediscussed pins (such as the pins 27) and the nut 342 constitute but two forms of means for releasably holding the insert in the handle or for releasably holding the insert in the receptacle. Holding means in the form of one or more pins are preferred at this time due to their simplicity and low cost. Thus, even a single pin suffices to reliably hold the insert in the handle or in the receptacle. It is preferred to employ at least two pins which engage the respective collar or rim (such as 34) at two points diametrically opposite each other. Such pins cooperate with the surface bounding the groove of the insert to act not unlike a rudimentary bearing which ensures that the insert and the handle can be turned relative to each other in response to the exertion of a minimal effort. The thrust bearing 344 of FIG. 7 is even more effective. If the holding means for the insert comprises two pins, the pins are preferably mounted in a manner as shown, for example, in FIG. 1, i.e., to engage the insert at points which are disposed diametrically opposite each other. If three or more pins are employed, the locations of engagement with the insert are preferably equidistant from each other in the circumferential direction of the respective collar.

It is further possible to replace the illustrated holding means with holding means which act not unlike detents with snap action, i.e., the insert can be introduced into its socket to thereby induce one or more mobile detent elements to engage one or more complementary detent elements in the socket and to thus hold the insert in an optimum position in which the insert can turn relative to the handle and in which each passage of the insert is free to communicate with the corresponding channel irrespective of the selected angular position of the handle relative to the insert and/or vice versa.

The aforediscussed guard can perform one or more functions. Thus, the guard can serve exclusively as a means for preventing direct contact between the hand which holds the handle and the object or objects to be coated with paint or the like. Furthermore, the guard can be widened to constitute an effective shield which intercepts droplets of a liquid from rebounding on impact against an object to be coated or similarly treated and from depositing on the hand holding the handle. Still further, the guard can serve as a shroud for one or more channels, especially if such channels are to convey heated flowable media which would be likely to rapidly overheat the handle if they were to be conveyed through one or more channels (note the channel 10 in FIG. 1) which are provided in the handle proper.

As mentioned above, the channel which extends through the handle preferably serves to convey a gaseous fluid, such as compressed air (provided, of course, that one of the conveyed flowable media is a gas). This ensures that the gaseous medium encounters a minimum of resistance to the flow toward the front portion of the barrel. In addition, a conventional valve can be used to regulate the flow of gaseous fluid in the channel which extends through the handle and into the rear portion of the barrel.

The aforediscussed design wherein the insert has a predetermined neutral position with reference to the handle or with reference to the receptacle exhibits the advantage that cleaning of the annular space or spaces is more likely to result in uniform removal of impurities (e.g., incrustated flowable material) from each and every portion of each annular space.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A spray gun for discharging a plurality of flowable materials, comprising a housing having a socket and a plurality of channels, one for each of the plurality of flowable materials, in communication with said socket, said housing including a pistol grip handle having an underside and said socket being provided at the underside of and in said handle; an insert freely turnably received in said socket and having a plurality of passages each communicating with a different one of said channels but with the same channel in each angular position of said housing and said insert relative to each other; and means for supplying flowable materials to said passages.

2. The spray gun of claim 1, wherein said means for supplying comprises conduits.

3. The spray gun of claim 1, wherein said housing and said insert are rotatable through at least 360 degrees with reference to each other.

4. The spray gun of claim 1, wherein said insert has a peripheral surface and said handle has an internal surface surrounding said peripheral surface, at least one of said surfaces having at least one annular space communicating with one of said passages and with one of said channels.

5. The spray gun of claim 1, wherein said insert is substantially cylindrical.

6. The spray gun of claim 1, wherein said insert has an end face and at least one of said passages has a discharge end in said end face.

7. The spray gun of claim 6, wherein said handle has a bottom surface confronting said end face and at least one of said channels has an intake end in said bottom surface.

8. The spray gun of claim 7, wherein said end face is spaced apart from and defines a chamber with said bottom surface.

9. The spray gun of claim 7, wherein said housing and said insert are turnable relative to each other about a predetermined axis.

10. The spray gun of claim 1, wherein said inset includes a first portion in said socket and a second portion which is enlarged with respect to said first portion and is connected with said supplying means.

11. The spray gun of claim 10, wherein said enlarged portion is outwardly adjacent said socket.

12. The spray gun of claim 1, further comprising means or releasably holding said insert in said socket.

13. The apparatus of claim 12, wherein said holding means comprises at least one pin provided in said housing and extending into said socket, said insert having an annular peripheral groove receiving a portion of said at least one pin.

14. The apparatus of claim 1, further comprising cooperating male and female detent means for releasably holding said insert in said socket, one of said detent means being provided on said housing and the other of said detent means being provided on said insert.

15. The spray gun of claim 1, wherein said housing comprises a main portion including said handle and a receptacle in said handle, said socket being provided in said receptacle and further comprising cooperating male and female detent means for releasably holding said receptacle in said handle, one of said detent means being provided on said handle and the other of said detent means being provided on said receptacle.

16. The spray gun of claim 1, wherein said handle has a bottom surface in said socket and only one of said channels is provided in said handle and has an intake end in said bottom surface.

17. The spray gun of claim 1, wherein said handle has a bottom surface in said socket and said insert has an end face adjacent said bottom surface, one of said channels having an intake end in said bottom surface and one of said passages having a discharge end in said end face, said supplying means including means for admitting a gaseous fluid into said one passage.

18. The spray gun of claim 1, wherein said insert has a peripheral surface and said handle has an internal surface surrounding said peripheral surface, at least one of said surfaces having at least one annular space, one of said channels having an intake end which communicates with said at least one space and one of said passages having a discharge end communicating with said at least one space, said insert being turnable with reference to said handle to and from a neutral position in which said discharge end is located substantially diametrically opposite said intake end.

19. A spray gun for discharging a plurality of flowable materials, comprising a housing having a socket and a plurality of channels, one for each of the plurality of flowable materials, in communication with said socket, said housing including a main portion and a receptacle removably installed in said main portion, said socket being provided in said receptacle; an insert turnably received in said socket and having a plurality of passages each communicating with a different one of said channels but with the same channel in each angular position of said housing and said insert relative to each other; and means for supplying flowable materials to said passages.

20. The spray gun of claim 19, further comprising means for non-rotatably holding said receptacle in said main portion.

21. The spray gun of claim 19, wherein said insert has a peripheral surface and said receptacle has an internal surface surrounding said peripheral surface, at least one of said surfaces having at least one annular space communicating with one of said passages and with one of said channels.

22. The spray gun for discharging a plurality of flowable materials, comprising a housing having a socket and a plurality of channels, one for each of the plurality of flowable materials, in communication with said socket, said housing including a main portion and a receptacle in said main portion, said socket being provided in said receptacle; an insert turnably received in said socket and having a plurality of passages each communicating with a different one of said channels but with the same channel in each angular position of said housing and said insert relative to each other; means for releasably retaining said insert in said receptacle; and means for supplying flowable materials to said passages.

23. The spray gun of claim 22, further comprising means for releasably holding said receptacle in said main portion of said housing, said holding means including at least one pin provided in said main portion and a recess provided in said receptacle and receiving a portion of said pin.

24. A spray gun for discharging a plurality of flowable materials, comprising a housing having a first socket and a plurality of channels, one for each of the plurality of flowable materials, in communication with said first socket, said housing including a pistol grip handle having an underside, a guard in front of said handle and a barrel having a fluid discharging front portion remote from said handle, at least one of said channels being provided in said guard and said guard having a first portion secured to said handle in the region of said underside and a second portion secured to said barrel in the region of said front portion; an insert turnably received in said first socket and having a plurality of passages each communicating with a different one of said channels but with the same channel in each angular position of said housing and said insert relative to each other, said handle including a receptacle for said insert and said first socket being provided in said receptacle, said handle further having a second socket for a first portion of said receptacle and said receptacle having a second portion disposed outside of said second socket, the first portion of said guard being secured to said receptacle; and means for supplying flowable materials to said passages.

* * * * *